United States Patent [19]

Mowbray

[11] 4,392,793

[45] Jul. 12, 1983

[54] FUEL PUMPING APPARATUS

[75] Inventor: Dorian F. Mowbray, Burnham, England

[73] Assignee: Lucas Industries Limited, Birmingham, England

[21] Appl. No.: 309,791

[22] Filed: Oct. 8, 1981

[30] Foreign Application Priority Data

Dec. 5, 1980 [GB] United Kingdom ..... 8039035

[51] Int. Cl.[3] ..... F04B 19/22; F04B 29/00

[52] U.S. Cl. ..... 417/462

[58] Field of Search ..... 417/462, 214

[56] References Cited

U.S. PATENT DOCUMENTS 3,883,270 5/1975 Baxter ..... 417/462

4,067,304 1/1978 Potter ..... 417/462

*Primary Examiner*—William L. Freeh

[57] ABSTRACT

A fuel pumping apparatus of the rotary distributor type has cam followers comprising rollers supported by shoes interposed between the pumping plungers and the cam ring. Stop rings are provided to limit the outward movement of the followers and one of these rings is axially adjustable so that the amount of fuel supplied by the apparatus can be controlled. In order to provide reduced initial rate of injection of fuel the axial spacing of the surfaces on at least one of the followers which contact the stop rings, is smaller than in the case of the other plunger or plungers so that at the end of the filling stroke of the apparatus of the plunger associated with that follower will project outwardly further than the other plunger and hence will be moved inwardly before the other to provide delivery of fuel at a reduced rate.

2 Claims, 1 Drawing Figure

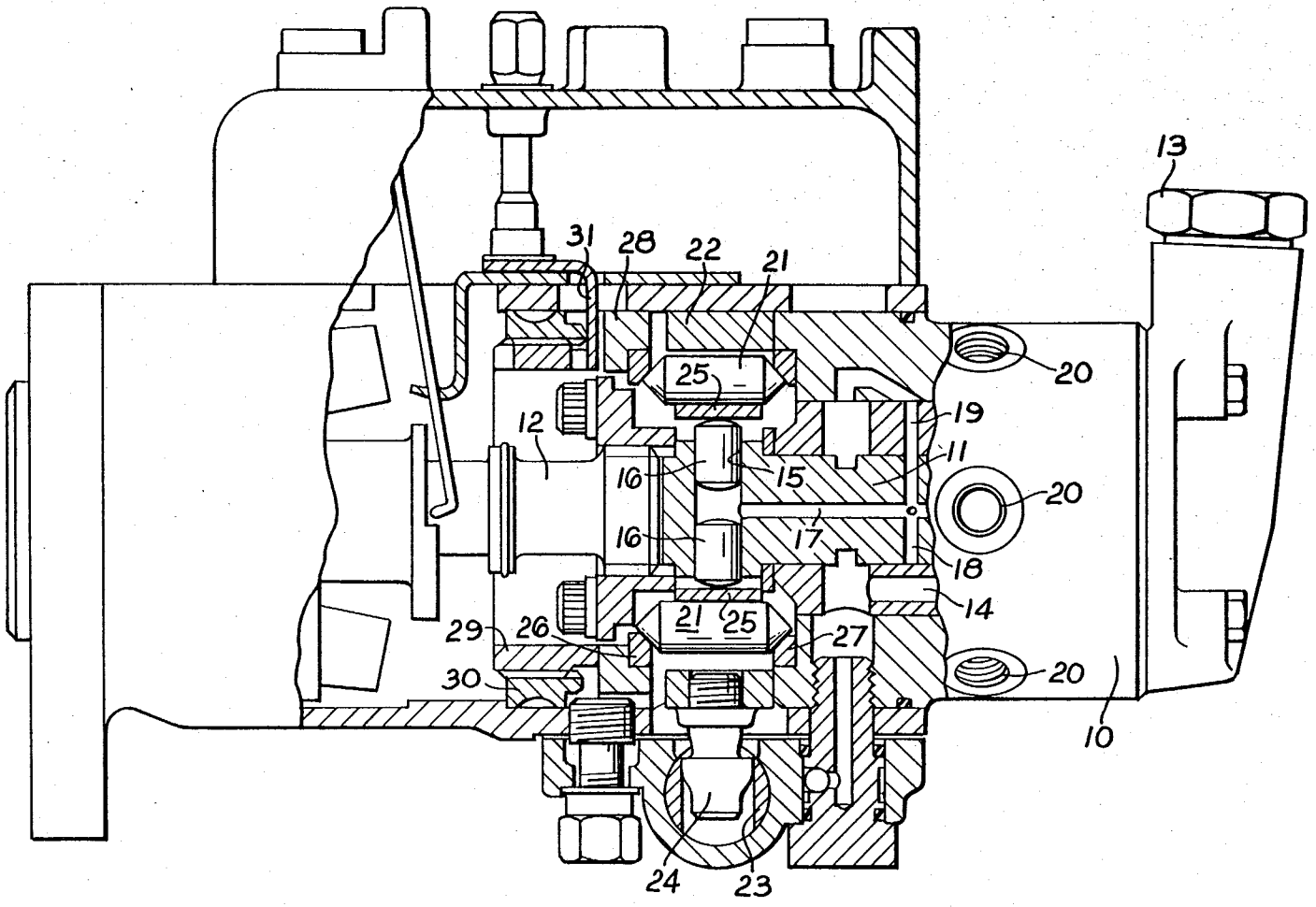
13
10
20
20
20
19
11
18
14
27
17
15
21
25
23
22
25
21
24
28
16
16
31
12
26
29
30

FUEL PUMPING APPARATUS

This invention relates to liquid fuel injection pumping apparatus for supplying fuel to an internal combustion engine and of the kind comprising a rotary distributor member located in a housing, bores formed in the distributor member and plungers therein, cam followers located at the outer ends of the plungers respectively for engagement with cam lobes formed upon the internal peripheral surface of an annular cam ring surrounding the distributor member, means for feeding fuel to the bores to effect outward movement of the plungers and followers, passage means for conveying fuel from the bores to outlets in the housing, a pair of stop rings positioned in the housing so as to be contacted by end surfaces defined on the cam followers, said end surfaces and the stop rings being shaped so that the axial setting of said stop rings will determine the extent of outward movement of the plungers during the time fuel is supplied to the bores thereby to determine the amount of fuel supplied at each delivery stroke of the apparatus.

Such apparatus is well known in the art and it provides for a variable start of delivery of fuel depending upon the volume of fuel contained in the bores at the end of the filling stroke. As is well known, the termination of fuel delivery is constant irrespective of the volume of fuel delivered. The instant at which fuel delivery starts, advances with an increase in the quantity of fuel delivered. The leading flanks of the cam lobes are designed so that delivery of fuel takes place quickly and it is not possible to vary the shapes of the cam lobes to obtain a low initial rate of delivery over the full range of the fuel delivery volume. It may be possible to obtain a low initial rate of delivery at the maximum fuel volume only.

A low initial rate of fuel delivery is desired for many engines over the full range of fuel delivery volume and the object of the present invention is to provide a pump of the kind specified in which this desideratum is achieved.

According to the invention an apparatus of the kind specified is characterized in that the axial spacing between the end surfaces of at least one of said cam followers is arranged to be smaller than the axial spacing of the end surfaces of the other cam follower or followers whereby in use, at the end of the filling strokes of the plungers at least one plunger will be further from the axis of rotation of the distributor member than the other or others so that it will be moved inwardly to effect delivery of fuel before the other plunger or plungers.

An example of an apparatus in accordance with the invention will now be described with reference to the accompanying drawing which is a sectional side elevation of the apparatus.

Referring to the drawing there is provided a housing 10 in which is mounted a rotary cylindrical distributor member 11 and this at one end, is coupled to a drive shaft 12 adapted in use, to be driven from a rotary part of the engine so that the distributor rotates in timed relationship with the engine. At its other end, the distributor member is coupled to the rotary part of a fuel feed pump having an inlet 13 and this delivers fuel under pressure to a supply passage 14 formed in the housing. Formed within the distributor member in the particular example, is a transversely extending bore 15 in which is located a pair of pumping plungers 16. The space defined between the pumping plunges communicates with a passage 17 formed in the distributor member at which at one position, communicates with a plurality of radially extending inlet passages 18 adapted to register in turn as the distributor member rotates, with a feed port 19. The feed port 19 is connected directly to the passage 14.

The passage 17 also communicates with a single delivery passage (not shown) and the delivery passage is arranged to register in turn and during the inward movement of the pumping plungers, with a plurality of outlets 20 formed in the housing and which in use are connected to the injection nozzles of the associated engine.

Surrounding the distributor member is an annular cam ring 22. The cam ring 22 is mounted for angular adjustment within a housing and such adjustment can be effected by means of a fluid pressure operable piston 23 which is connected to the cam ring by means of a radial peg 24. Formed on the internal peripheral surface of the cam ring is a plurality of cam lobes and these coact with rollers 21 which are carried by shoes 25 respectively the latter engaging the outer ends of the plungers 16. As the rollers 21 are moved inwardly, inward movement is imparted to the rollers and the shoes and also the plungers 16 and thereby fuel is displaced from the bore and flows to one of the outlets 20.

The rollers and shoes form cam followers and, as seen in the drawings, the ends of the rollers 21 are of conical form and define stop surfaces for engagement with complementary surfaces defined on a pair of stop rings 26, 27. The ring 27 is secured within the housing but the ring 26 is mounted on an axially movable ring member 28. The ring member 28 is engaged by a further ring member 29 on the periphery of which is formed a quick pitch screw thread and this is in engagement with a complementary thread formed on the internal periphery of an adjusting member 30. The ring member 29 and also the stop ring 28 are restrained against angular movement by means of a tongue 31 however, they can both move axially. The adjusting member 30 is restrained against axial movement but it can be moved angularly and when so moved, it affects the axial spacing of the stop rings 26, 27.

The spacing of the stop rings 26, 27 determines the position at which outward movement of the rollers 21, the shoes 25 and the pumping plungers is halted. The adjusting member 30 is connected to a governor mechanism so that at all times the amount of fuel which is supplied to the engine is determined by the amount the plungers 16 can move outwardly.

In order to obtain a low initial rate of delivery of fuel to the engine one of the rollers 21, the upper one in the drawing, is made axially shorter than the other so that the axial spacing between the stop surfaces is reduced. As a result at the end of the filling strokes of the plungers, the one roller together with the associated shoe and plunger, will be positioned further from the axis of rotation of the distributor member than the other. The effect of this is that the one roller will engage a cam lobe earlier than the other roller and therefore one plunger only, the upper one in the drawing, will start to move inwardly before the other. Since only one plunger is moving inwardly, the initial rate of fuel delivery is half that which is obtained when both plungers are moved inwardly. The other plunger is held against outward movement due to the fuel pressure in the pumping chamber, by the abutment of the stop surfaces on the roller with the stop rings.

In the example described only two plungers have been illustrated. It is of course possible to apply the technique to a pump having for example four plungers. In this case possibly two of the plungers will be arranged to move inwardly before the other plungers.

In the particular example the stop surfaces which engage with the stop rings are formed on the rollers. It is possible however to extend the shoes and to incline the the end surfaces thereof for engagement by the stop rings. Again by reducing the axial distance between the end surfaces on one or more of the shoes, the plunger or plungers associated with that shoe or shoes will at the end of the filling stroke, assume a position further from the axis of rotation of the distributor member and hence will be moved inwardly before the other plunger or plungers.

I claim:

1. A liquid fuel injection pumping apparatus for supplying fuel to an internal combustion engine and comprising a rotary distributor member located in a housing, bores formed in the distributor member and plungers therein, cam followers located at the outer ends of the plungers respectively for engagement with cam lobes formed upon the internal peripheral surface of an annular cam ring surrounding the distributor member, means for feeding fuel to the bores to effect outward movement of the plungers and followers, passage means for conveying fuel from the bores to outlets in the housing, a pair of stop rings positioned in the housing so as to be contacted by end surfaces defined on the cam followers, said end surfaces and the stop rings being shaped so that the axial setting of said stop rings will determine the extent of outward movement of the plungers during the time fuel is supplied to the bores thereby to determine the amount of fuel supplied at each delivery stroke of the apparatus, characterized in that the axial spacing between the end surfaces of at least one of said cam followers is arranged to be smaller than the axial spacing of the end of the other cam follower or followers whereby in use, at the end of the filling strokes of the plungers at least one plunger will be further from the axis of rotation of the distributor member than the other or others so that it will be moved inwardly to effect delivery of fuel before the other plunger or plungers.

2. An apparatus according to claim 1 in which said cam followers each comprise a roller supported by a shoe, said rollers having conical ends for engagement with said stop rings.

* * * * *